US007645966B2

(12) United States Patent
Hayakawa et al.

(10) Patent No.: US 7,645,966 B2
(45) Date of Patent: Jan. 12, 2010

(54) ATTACHMENT STRUCTURE OF STORAGE UNIT

(75) Inventors: Yuji Hayakawa, Nara (JP); Kouji Kanzaki, Yamatokoriyama (JP); Toshifumi Kamiya, Yamatotakada (JP); Takashi Sugimoto, Yokohama (JP); Yasuhiko Inoue, Yokohama (JP); Yukikazu Niizuma, Yokohama (JP)

(73) Assignee: Panasonic Corporation, Osaka (JP)

( * ) Notice: Subject to any disclaimer, the term of this patent is extended or adjusted under 35 U.S.C. 154(b) by 1105 days.

(21) Appl. No.: 10/653,648

(22) Filed: Sep. 2, 2003

(65) Prior Publication Data

US 2005/0029268 A1 Feb. 10, 2005

(30) Foreign Application Priority Data

Sep. 3, 2002 (JP) ..... P. 2002-257858

(51) Int. Cl.
*H05B 6/68* (2006.01)
*F22B 1/02* (2006.01)

(52) U.S. Cl. ..... 219/756; 219/682; 219/723; 122/31.1

(58) Field of Classification Search ..... 219/401, 219/629, 682, 688, 702, 710, 734, 759, 700, 219/723, 739, 398, 721, 724, 714; 126/200, 126/21 A, 39 E, 42, 191, 194, 197
See application file for complete search history.

(56) References Cited

U.S. PATENT DOCUMENTS

| | | | | |
|---|---|---|---|---|
| 4,450,335 | A * | 5/1984 | Shimizu et al. | 219/723 |
| 4,454,404 | A | 6/1984 | Zushi | |
| 4,826,224 | A * | 5/1989 | Lee | 292/254 |
| 5,660,755 | A * | 8/1997 | Michaluk, III | 219/734 |
| 6,232,587 | B1 * | 5/2001 | Kurita et al. | 219/682 |

FOREIGN PATENT DOCUMENTS

| | | | |
|---|---|---|---|
| DE | 39 41 322 | A1 | 6/1991 |
| EP | 0 952 400 | A1 | 10/1999 |
| JP | 9-101034 | | 8/1998 |
| JP | 2003176918 | A * | 6/2003 |

* cited by examiner

*Primary Examiner*—Quang T Van
(74) *Attorney, Agent, or Firm*—Pearne & Gordon LLP

(57) ABSTRACT

An attachment structure of a storage unit having: a tank casing body; a tank casing door member, and a lock portion; and an operation member, and a push button, wherein: an outer circumference of a storage unit is surrounded with an opening portion of an exterior panel; the push button is protruded from an outer surface of the exterior panel in a mount position of the exterior panel when the exterior panel is in assembling work; and a space for inserting a circumferential edge of the opening portion of the exterior panel is formed on the back of the push button.

6 Claims, 15 Drawing Sheets

ATTACHMENT STRUCTURE OF STORAGE UNIT

BACKGROUND OF THE INVENTION

The present invention relates to an attachment structure of a storage unit in any kind of equipment such as a microwave heating apparatus having the storage unit in which a water supply tank containing water for generating steam is stored.

As microwave heating apparatuses in the conventional art, there are a single function type apparatus for performing only microwave heating, a combination oven having a convection heater for performing heater heating in addition to microwave heating, and so on. A microwave heating apparatus capable of supplying microwave and stream into a heating chamber has been also discussed.

As disclosed in JP-A-09-101034 (Japanese Application Publication Number: Hei09-101034), for the microwave heating apparatus to which a steam generating function is added, various methods such as a method of generating steam from a boiler provided outside the heating chamber and introducing the steam into the heating chamber have been proposed.

The microwave heating apparatus to which such a steam generating function is added has a water supply tank that can be attached/detached to/from a storage space formed in an exterior. Water in the water supply tank is dripped into the boiler by a water feed pump.

In the recent microwave heating apparatus, an operation panel of the microwave heating apparatus has been arranged in a door portion or a control circuit has been arranged near the bottom for the requirement of increase in volume of the heating chamber and reduction in size of the apparatus as a whole. In the microwave heating apparatus formed so that the water supply tank can be attached/detached to/from the storage space formed outside the apparatus, the storage space has to be provided as a large space for setting the water supply tank detachably. This however causes difficulty of attaining increase in volume of the heating chamber and reduction in size of the apparatus as a whole.

It may be therefore conceived that the water supply tank is stored in a narrow space between the heating chamber and an exterior panel in a side portion, etc. of the apparatus. When a storage portion for storing the water supply tank is provided in this space, there is however a problem that it is difficult to mount the exterior panel on the apparatus body.

Particularly when the exterior panel constituting a top surface and opposite side surfaces of the apparatus is U-shaped in section in advance so that the exterior panel will be fitted while slid from above or the back of the heating chamber in order to attain facilitation of the assembling work, an end surface etc. of the exterior panel is caught in the water supply tank so that the exterior panel cannot be mounted on the apparatus body even in the case where the exterior panel is slid because the storage portion of the water supply tank protruded outward from the exterior panel interferes with the exterior panel at the time of slide mounting of the exterior panel on the apparatus body.

SUMMARY OF THE INVENTION

The invention is developed in consideration of the problem in the conventional art and an object of the invention is to provide an attachment structure of a storage unit in which reduction in equipment size can be attained while facilitation of mounting of an exterior panel can be retained.

To achieve the foregoing object, the present invention provides an attachment structure of a storage unit including: a casing base attached to equipment and provided for forming a space for holding an object to be stored; an open/close member including a support portion for supporting the open/close member to the casing base on one side so as to make the open/close member opened/closed freely, and a lock portion for locking the open/close member on the casing base on the other end, the open/close member blocking the space of the casing base in a closed state and biased in a direction of departing from the casing base; and an operation member including an engagement portion engaged with the lock portion to keep the open/close member locked on the casing base, and a push button for unlocking the open/close member by a pushing-down operation of the push button, wherein: an outer circumference of the storage unit is surrounded with an opening portion of an exterior panel of the equipment; the push button of the operation member is protruded from a panel surface which is an outer surface of the exterior panel in a mount position of the exterior panel, when said exterior panel is in assembling work; and a space for inserting a circumferential edge of the opening portion of the exterior panel is formed on the back of the push button.

In the attachment structure of the storage unit, the open/close member is unlocked when the push button of the operation member is pushed down. The open/close member is locked on the casing base when the open/close member is pushed back in a direction reverse to the biasing direction of the operation member. In the locked state of the open/close member, the push button of the operation member is protruded from the panel surface of the exterior panel located in the mount position, so that the space for inserting a circumferential edge of the opening portion of the exterior panel is formed. Accordingly, when the circumferential edge of the opening portion of the exterior panel is inserted into the space for putting and mounting the exterior panel on the equipment, for example, engagement pawls formed in the exterior panel can be easily slid and inserted into a frame portion of the equipment, so that the exterior panel can be easily assembled. In addition, the degree of freedom in design of the equipment is improved so that reduction in size of the equipment can be attained.

Preferably, in the attachment structure of the storage unit according to the invention, a decoration panel for covering a gap between the storage unit and the opening portion of the mounted exterior panel is fixed so that the push button of the operation member protruded from the panel surface is substantially on the same plane with an outer surface of the decoration panel.

In the attachment structure of the storage unit, the push button of the operation member is substantially on the same plane with the outer surface of the decoration panel, so that the protrusive portion on the outer surface of the equipment can be eliminated. Accordingly, the external appearance of the equipment after assembling can be made good. In addition, because the protrusive portion can be eliminated, the equipment can be formed to be excellent in safety.

Preferably, in the attachment structure of the storage unit according to the invention, the open/close member is unlocked from the casing base when the push button of the operation member is pushed down so as to be deeper than the outer surface of the decoration panel.

In the attachment structure of the storage unit, the open/close member can be opened when the push button of the operation member is pushed down so as to be deeper than the outer surface of the decoration panel. Hence, a drawback in opening of the open/close member carelessly can be eliminated surely.

Preferably, in the attachment structure of the storage unit according to the invention, each of the lock portion of the open/close member and the engagement portion of the operation member has an abutting surface, and an engagement surface, the respective abutting surfaces sliding while abutting on each other, the respective engagement surfaces engaged with each other when sliding of the abutting surfaces is completed, each of the abutting surfaces having a length sufficient to slide continuously from a state in which the push button of the operation member is protruded from the panel surface to a state in which the push button is pushed down so as to be deeper than the outer surface of the decoration panel.

In the attachment structure of the storage unit, the abutting surfaces slide on each other and then the engagement surfaces are engaged with each other when the open/close member opened is forced into the equipment side. Hence, the open/close member can be kept closed steadily and easily.

Preferably, in the attachment structure of the storage unit according to the invention, the operation member is biased in a direction reverse to the pushing-down direction by barrel-shaped coiled springs.

When the space on the back of the push button is disposed on an end portion side where the diameter of each spring is tapered, the space for insertion of the exterior panel can be enlarged so that the exterior panel can be mounted more easily.

DESCRIPTION OF THE PREFERRED EMBODIMENT

A preferred embodiment of an attachment structure of a storage unit according to the invention will be described below in detail with reference to the drawings.

Incidentally, the description will be made while a microwave heating apparatus is taken as an example of the equipment to which the storage unit is attached.

Figure 1:
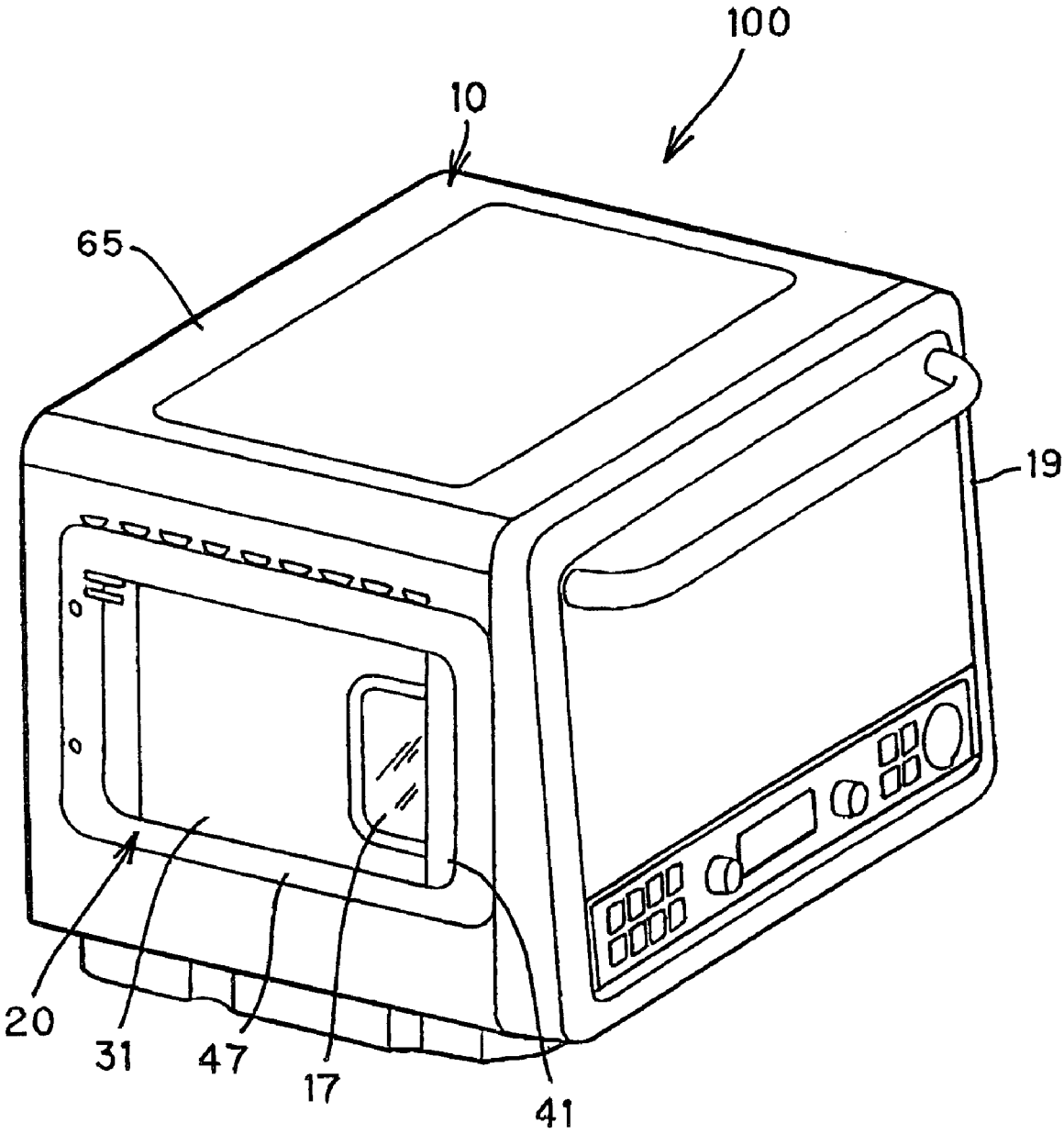
FIG. 1 is a perspective view showing the external appearance of a microwave heating apparatus according to the invention.
Figure 2:
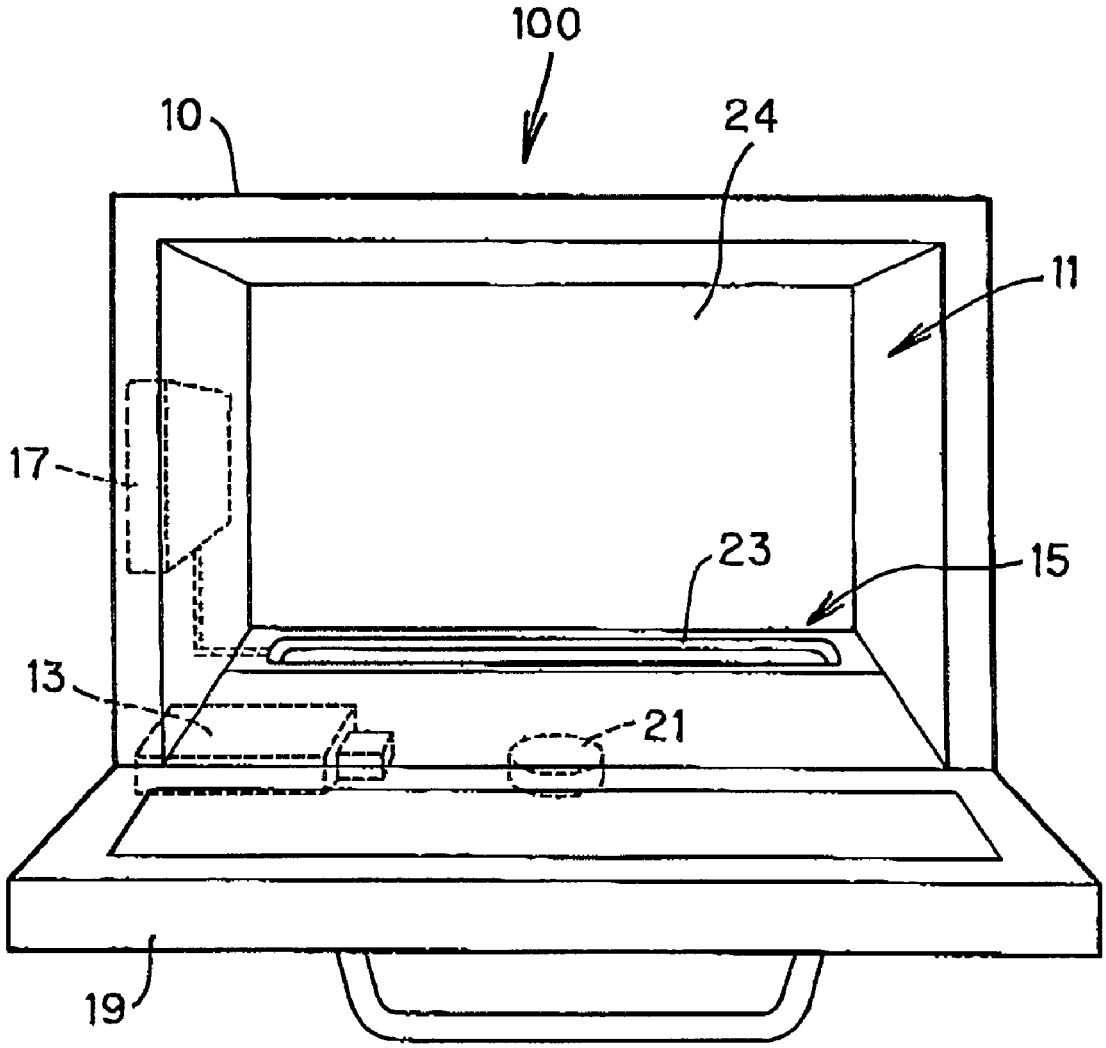
FIG. 2 is a schematic front view showing a state in which an open/close door of the microwave heating apparatus is opened.

FIG. 1 is a perspective view showing the external appearance of the microwave heating apparatus according to the invention. FIG. 2 is a schematic front view showing a state in which an open/close door of the microwave heating apparatus is opened.

As shown in FIG. 1 by way of example, the invention has a special feature in that a storage unit 20 in which a water supply tank 17 for supplying water into a steam generating portion included in the microwave heating apparatus (equipment) 100 is stored is provided on a side of the microwave heating apparatus 100, and in that a space for inserting an exterior panel 65 is provided on the back of a push button 41 included in the storage unit 20. First, the basic configuration and operation of the microwave heating apparatus 100 as the equipment will be described.

As shown in FIG. 1 and FIG. 2, the microwave heating apparatus 100 is a heating cooker for heating a subject to be heated using at least one of microwave and steam supplied into a heating chamber 11 where the subject is housed. The microwave heating apparatus 100 has, as main constituent members, a magnetron 13 which is a microwave generating portion for generating microwave, a steam generating portion 15 for generating stream in the heating chamber 11, and a detachable water supply tank 17 connected to a water supply path led to the steam generating portion 15.

The heating chamber 11 is formed in the inside of a body casing 10 shaped like a box having an opened front portion. An open/close door 19 having a transparent window 19*a* for opening/closing a subject removal port of the heating chamber 11 is provided in a front surface of the body casing 10. A lower end of the open/close door 19 is connected to a lower edge of the body casing 10 by hinges, so that the open/close door 19 can be opened/closed in such a manner that an upper end of the open/close door 19 is moved back and forth with the lower end of the open/close door 19 as a center of rotation. A predetermined heat-insulating space is formed between walls of the heating chamber 11 and the body casing 10. As occasion demands, this space is filled with a heat-insulating material.

The magnetron 13 is disposed in a space under the heating chamber 11. A stirrer blade 21 is provided in a position where the stirrer blade 21 can receive microwave generated by the magnetron 13. When microwave generated by the magnetron 13 is applied to the stirrer blade 21 driven to rotate, the microwave is supplied into the heating chamber 11 while stirred by the stirrer blade 21. Although the description has been made on the case where the magnetron 13 and the stirrer blade 21 are provided in the bottom of the heating chamber 11, the invention is not limited thereto. For example, the magnetron 13 and the stirrer blade 21 may be provided in an upper or side surface of the heating chamber 11. Or a turntable may be provided instead of the stirrer blade 21 so that the subject side can be rotated.

The steam generating portion 15 has an evaporation pan 23 having a water reservoir cavity for generating steam by heating. Though not shown, an evaporation pan heating heater and a reflecting plate nearly U-shaped in section for reflecting radiation heat of the heater toward the evaporation pan 23 are provided below the evaporation pan 23. For example, the evaporation pan 23 is provided as a slender plate made of stainless steel. The evaporation pan 23 is disposed in the bottom of the heating chamber 11 on an inner side opposite to the subject removal port so that the lengthwise direction of the evaporation pan 23 goes along a partition plate 24. The evaporation pan 23 is provided so as to be out of the detection range in temperature detecting scanning of an infrared sensor not shown. Incidentally, a glass tube heater, a sheathed heater, a plate heater or the like may be used as the evaporation pan heating heater.

Figures 3A, 3B, 3C:
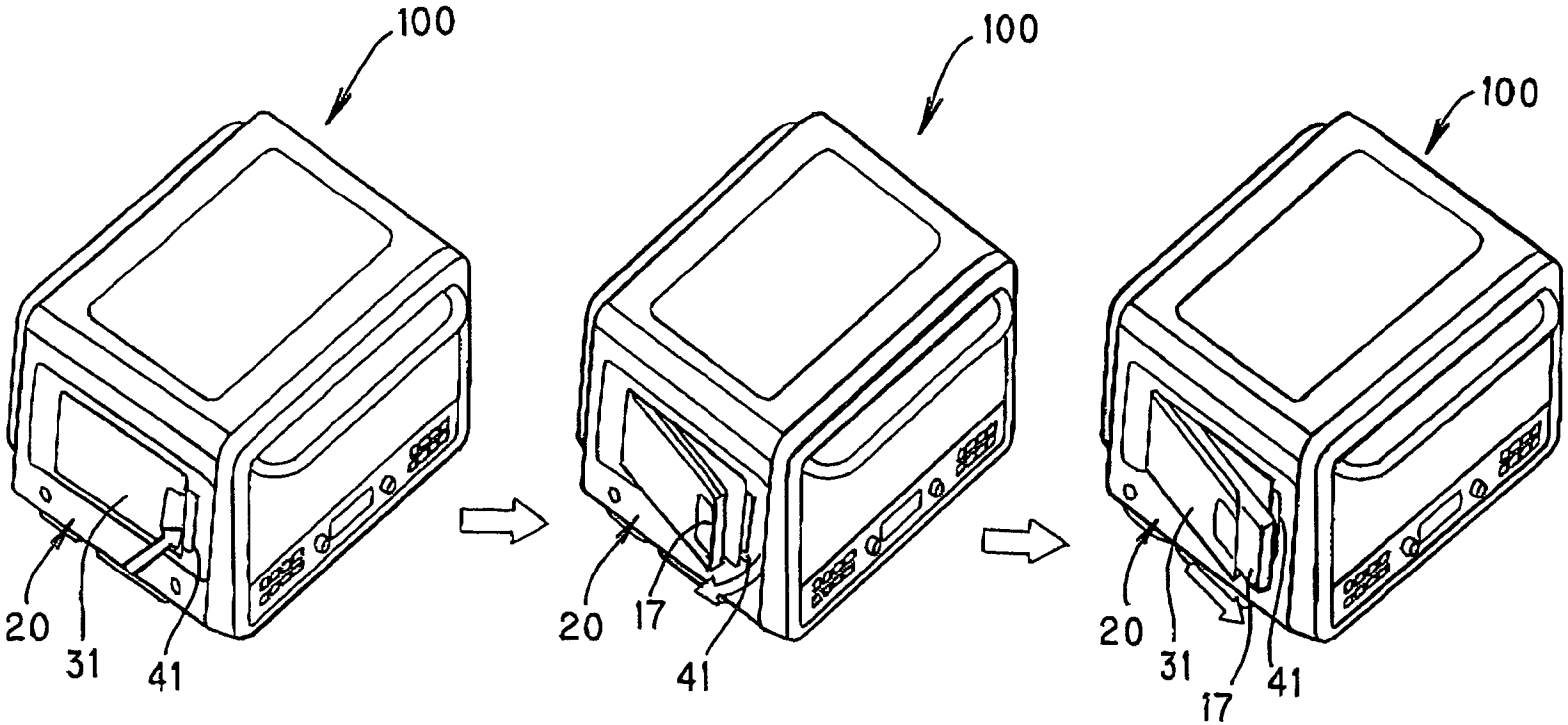
FIG. 3A to FIG. 3C are explanatory views showing a procedure for detaching a water supply tank from the microwave heating apparatus.

FIG. 3A to FIG. 3C show a procedure for removing the water supply tank 17 from the microwave heating apparatus 100. When a push button 41 provided on the front side of a side surface of the microwave heating apparatus 100 is pushed down inward the microwave heating apparatus 100 as shown in FIG. 3A, a tank casing door member 31 with the water supply tank 17 put therein is opened outward from the side surface of the microwave heating apparatus 100 as shown in FIG. 3B. When the water supply tank 17 is then pulled out toward the front side of the microwave heating apparatus 100 as shown in FIG. 3C, the water supply tank 17 can be removed.

The water supply tank 17 can be stored by a procedure reverse to the aforementioned procedure. That is, in the condition that the tank casing door member 31 is opened, the water supply tank 17 is slid and inserted into the tank casing door member 31 so that the water supply tank 17 goes deep. When the tank casing door member 31 is then pushed back inward the microwave heating apparatus 100, the tank casing door member 31 is locked in a closed state by an operation member 35.

Next, the structure of the storage unit 20 for disposing the water supply tank 17 attachable/detachable to/from the microwave heating apparatus 100 will be described.

Figure 4:
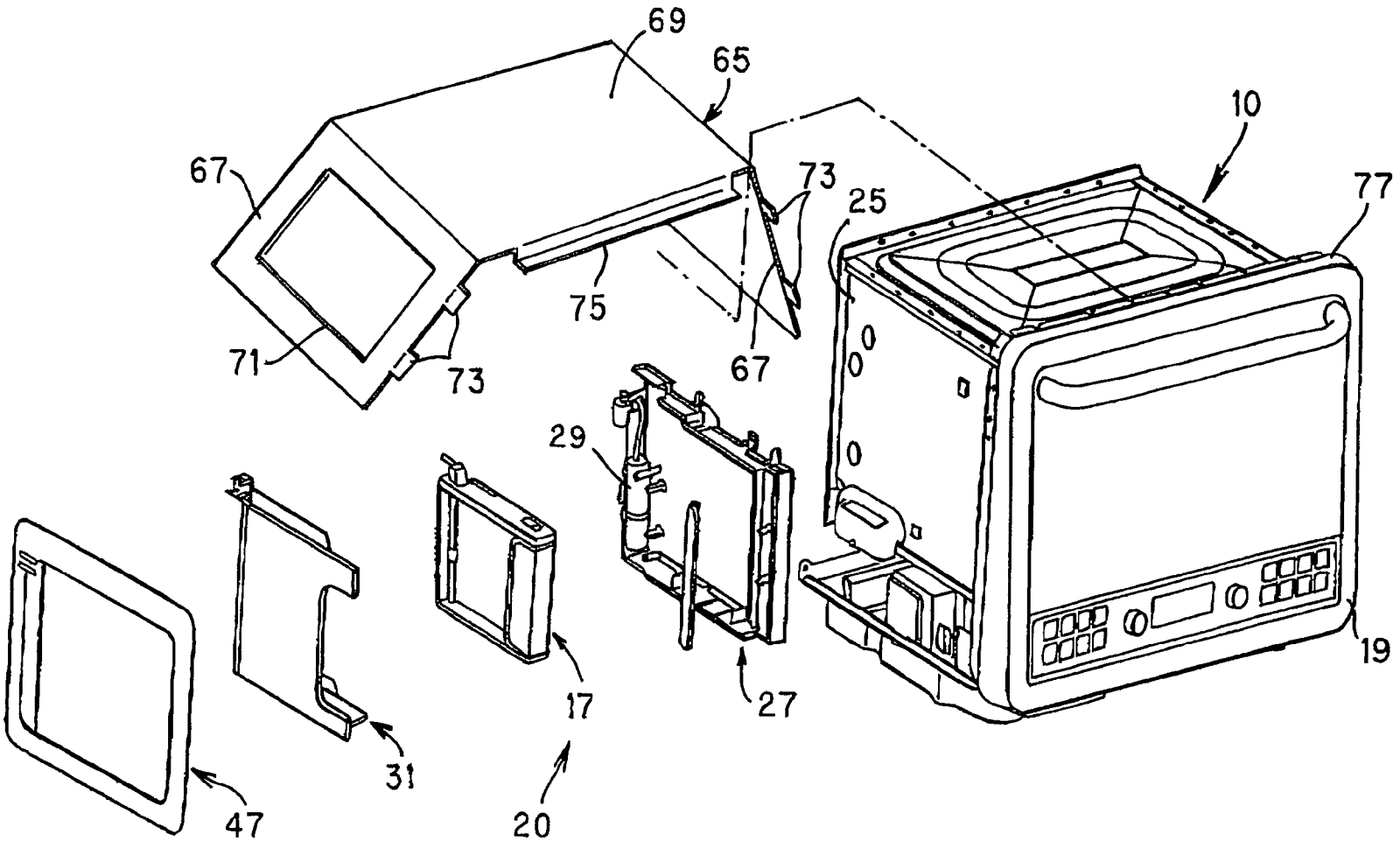
FIG. 4 is an exploded perspective view showing a configuration in which the water supply tank is arranged on a side of the microwave heating apparatus.
Figure 5A:
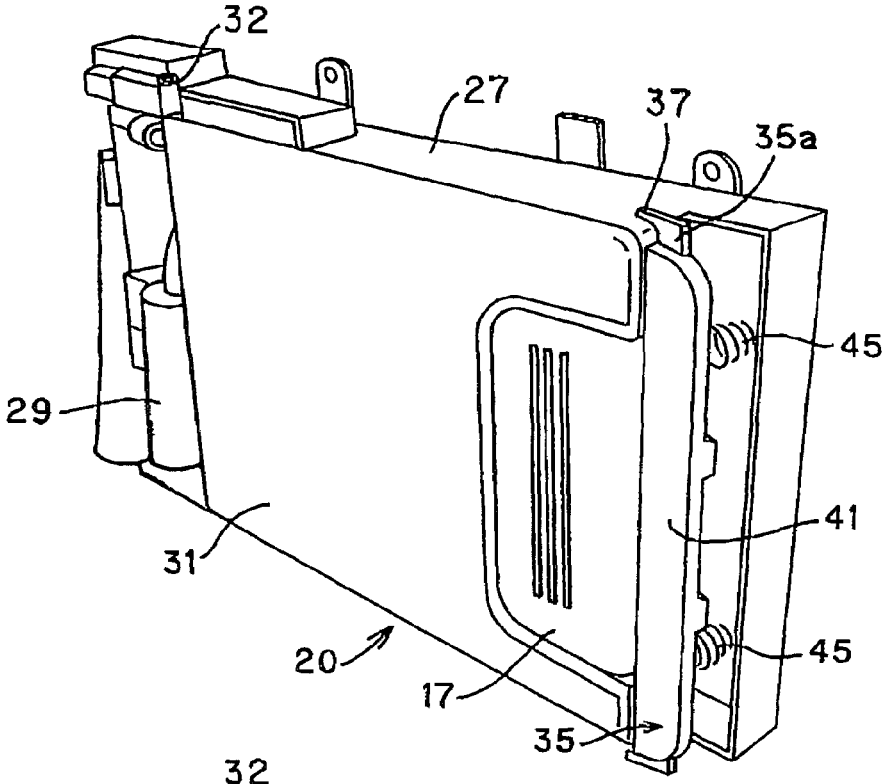
FIG. 5A and FIG. 5B are perspective views of a storage unit showing the structure of the storage unit.
Figure 5B:
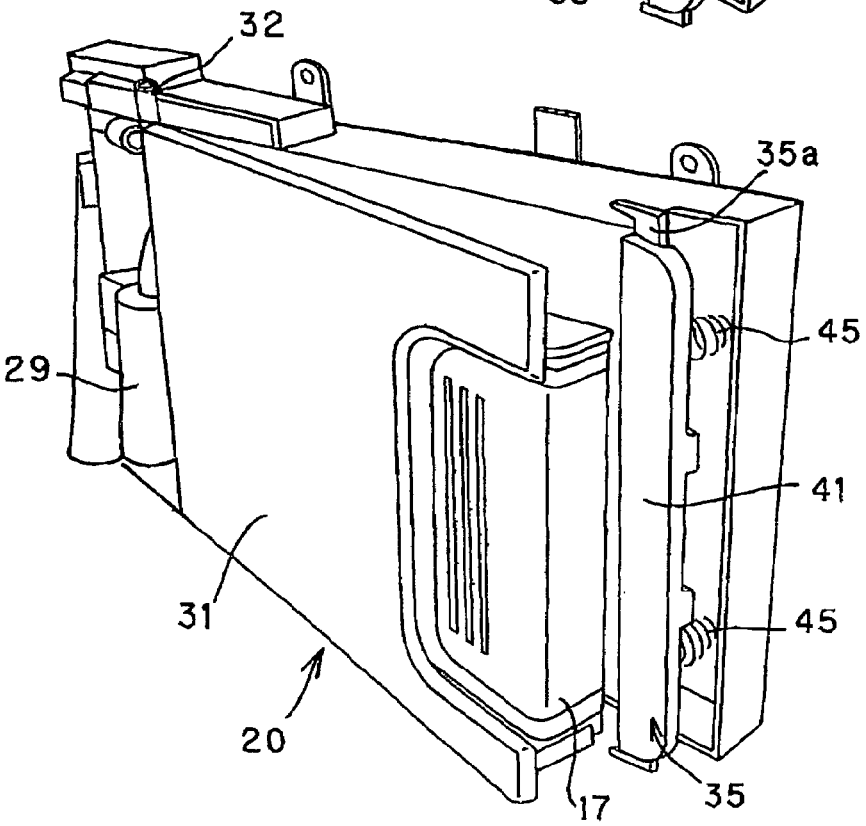
Figure 6:
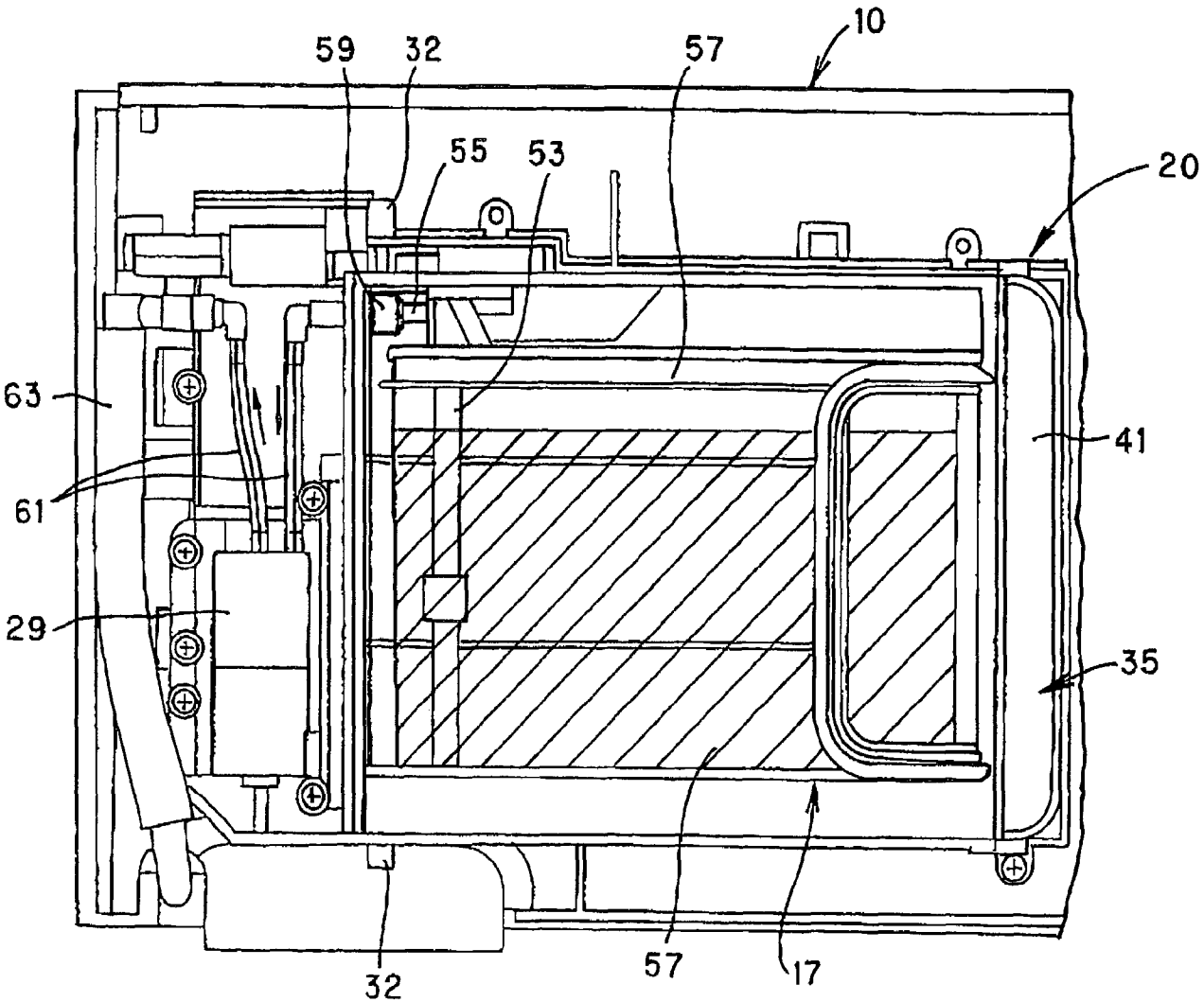
FIG. 6 is a front view of the storage unit showing the structure of the storage unit.

FIG. 4 is an exploded perspective view showing the storage unit 20 for disposing the water supply tank on a side of the microwave heating apparatus. FIG. 5A and FIG. 5B are perspective views showing the storage unit 20. FIG. 6 is a front view showing the storage unit 20.

As shown in FIG. 4, a side heat-insulating plate 25 is provided fixedly on a side of the microwave heating apparatus 100 with separation of a predetermined space from a side wall plate inside the heating chamber outward the microwave heating apparatus 100. A tank casing body 27 as a casing base is provided on the side heat-insulating plate 25 with interposition of a predetermined space between the tank casing body 27 and the side heat-insulating plate 25.

As shown in FIG. 5A and FIG. 5E, a water feed pump 29 is attached to the tank casing body 27. One end of the tank casing door member 31 as the open/close member is pivotally supported so as to be opened/closed freely with the support shaft 32 as a center of rotation. The water supply tank 17 is stored between the tank casing body 27 and the tank casing door member 31 while put in the tank casing door member 31.

Incidentally, the water supply tank 17 is shaped like a flattened rectangular parallelepiped. As shown in FIG. 6, the water supply tank 17 has a tank body 51, and a tank cover 57 which is provided with a water intake pipe 53 and a water supply port 55 fixed thereto and which can be attached/detached to/from the tank body 51.

When the water supply tank 17 is inserted into the tank casing door member 31, the water supply port 55 is connected to a water intake port 59 of the tank casing door member 31. In this state, the water feed pump 29 sucks water from the tank body 51 through the water intake pipe 53 and feeds the water into a feed hose 63 through a tube 61. As a result, the water is fed into the evaporation pan 23 (see FIG. 2) provided at a terminal of the feed hose 63.

Figure 7:
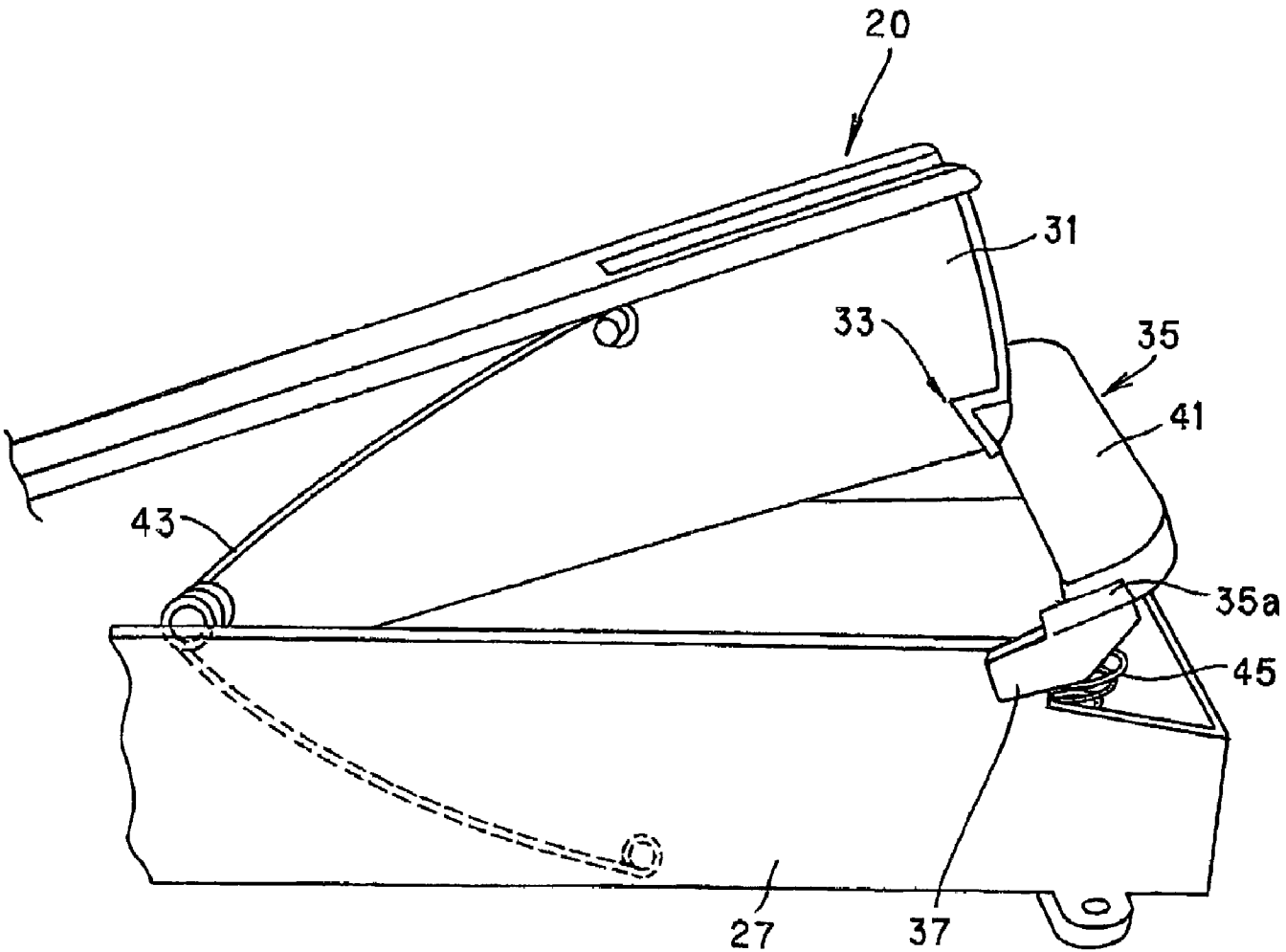
FIG. 7 is a perspective view showing part of the storage unit for explaining the storage unit and an operation member.

FIG. 7 shows an engagement portion between the tank casing body 27 and the tank casing door member 31. As shown in FIG. 7, a lock portion 33 for locking the tank casing door member 31 on the tank casing body 27 is provided on a side of the tank casing door portion 31 opposite to the support shaft 32.

An operation member 35 engaged with the tank casing door member 31 is mounted on the tank casing body 27. The operation member 35 is supported to upper and lower portions of the tank casing body 27 so that the operation member 35 can be rotated by a pair of support arms 37 formed at opposite ends of the operation member 35. A torsion coiled spring 43 is provided between the tank casing body 27 and the tank casing door member 31 for biasing the tank casing door member 31 in a direction of departing from the tank casing body 27 so that the tank casing door member 31 can be ejected outward the microwave heating apparatus 100 when the locked state of the lock portion 33 by the operation member 35 is unlocked.

Figure 8:
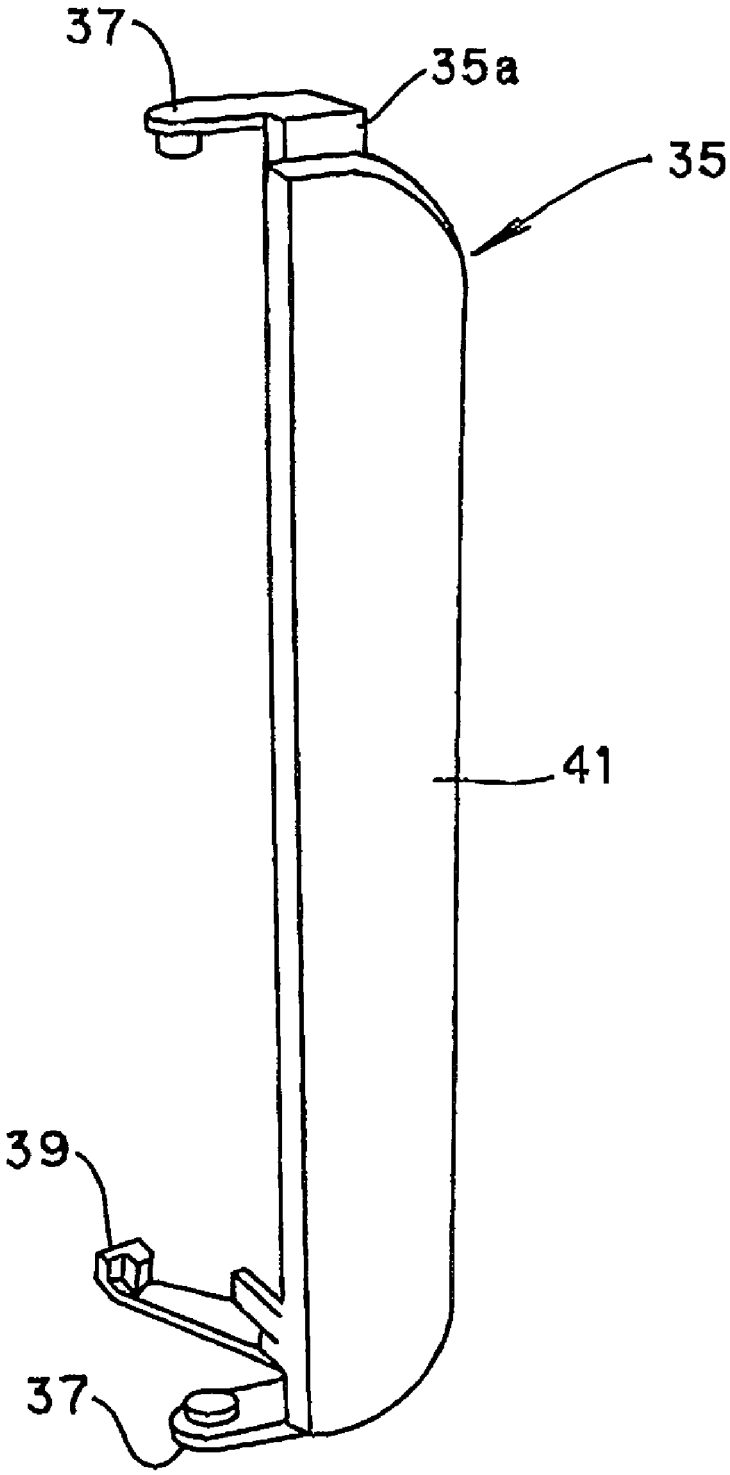
FIG. 8 is a perspective view showing the shape of the operation member of the storage unit.
Figure 9:
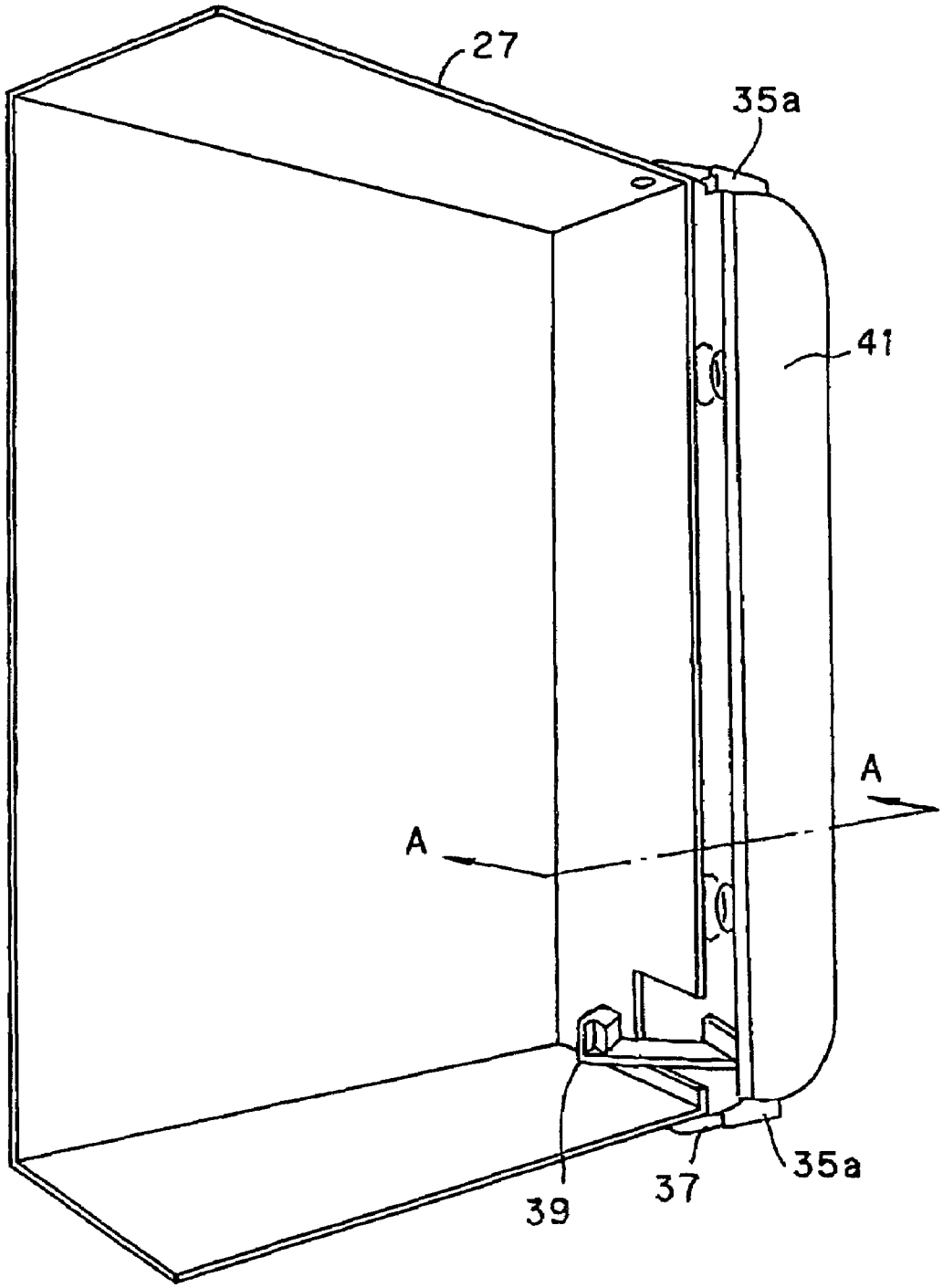
FIG. 9 is a perspective view showing amounting structure of the operation member of the storage unit.

FIG. 8 is a perspective view showing the shape of the operation member 35. FIG. 9 is a perspective view showing an attachment structure of the operation member 35.

As shown in FIG. 8 and FIG. 9, the operation member 35 has a pair of support arms 37 pivotally supported to the tank casing body 27 so as to be rotatable, an engagement portion 39 engaged with the lock portion 33 of the tank casing door member 31 to keep the tank casing door member 31 locked on the tank casing body 27, and a push button 41 for unlocking the locked state due to the engagement between the lock portion 33 and the engagement portion 39 by a pushing-down operation.

A plurality of barrel-shaped coiled springs 45 are attached onto the back of the push button 41 of the operation member 35 so as be suspended between the push button 41 and the tank casing body 27. The barrel-shaped coiled springs 45 urge the push button 41 in a direction reverse to the pushing-down direction, that is, in a direction against the pushing-down of the push button 41.

Figure 10:
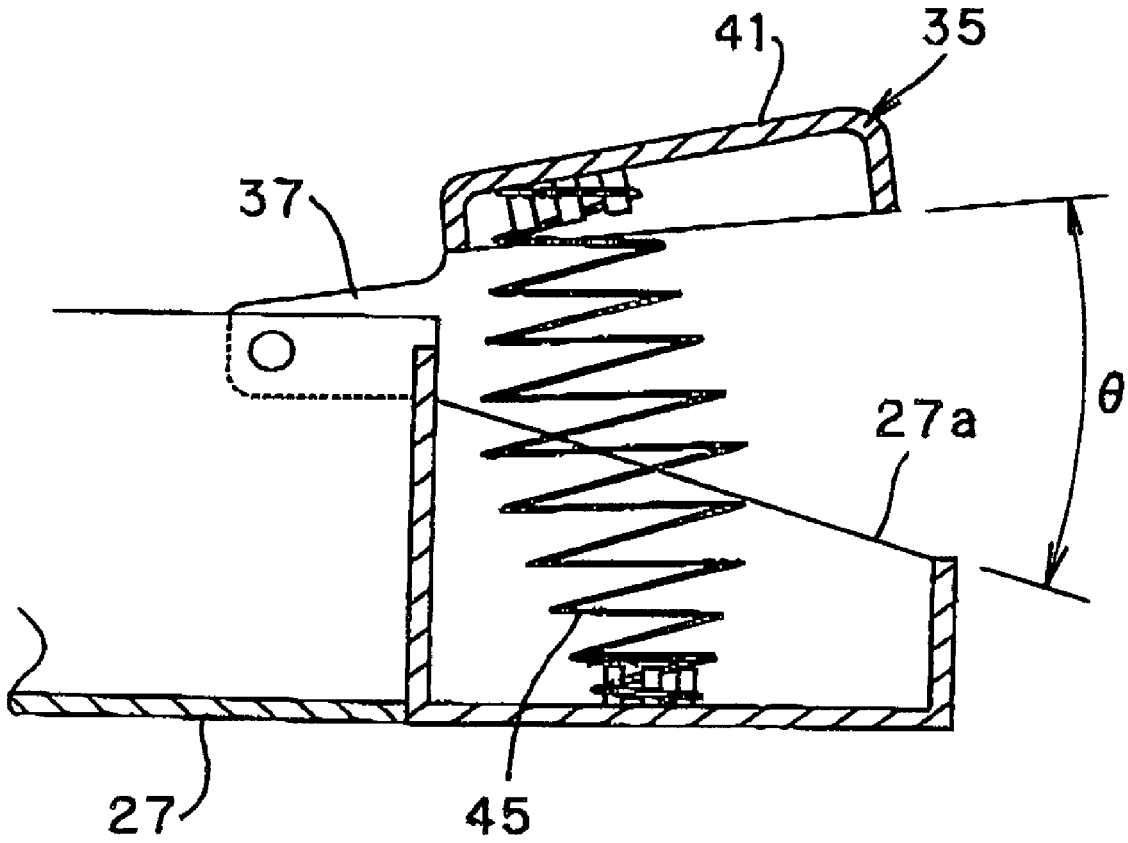
FIG. 10 is a sectional view, taken along the line A-A in FIG. 9, of the storage unit for explaining a push button arrangement structure of the operation member.

FIG. 10 is a sectional view taken along the line A-A in FIG. 9.

Figure 11:
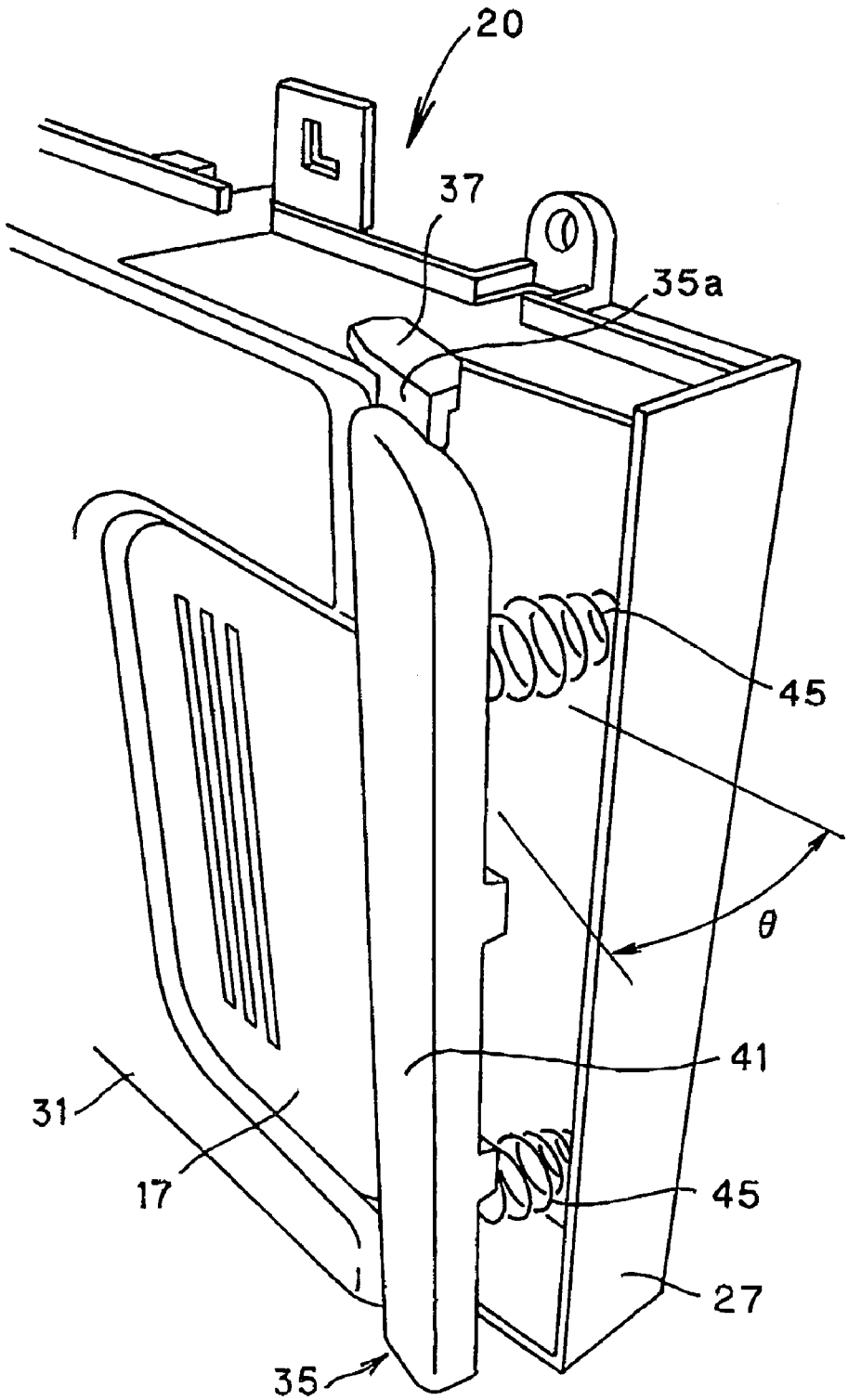
FIG. 11 is a perspective view showing part of the storage unit for explaining the push button arrangement structure of the operation member.

Each of the barrel-shaped coiled springs 45 is formed so that the coil diameter of the spring 45 is largest at its center and tapers toward opposite end portions to thereby prevent the spring 45 from being buckled by the pushing-down of the push button 41. The push button 41 of the operation member 35 is inclined outward the microwave heating apparatus 100 and formed to be opened widely outward according to the distance from the pivotal position of the support arms 37 as represented by the angle θ of aperture in cooperation with an inclined surface 27*a* of the opening at an end portion of the body casing 10. Incidentally, the barrel-shaped coiled springs 45 are provided in a space on the back of the push button 41 so that an end portion with a small spring diameter is disposed in the opening portion. FIG. 11 shows a state in which the push button 41 of the operation member 35 is opened outward. Consequently, as shown in FIG. 11, the exterior panel which will be described later can be inserted into the opening portion more deeply, so that the insertion space can be secured widely. As shown in FIG. 11, the storage unit 20 is attached to the side heat-insulating plate 25 of the microwave heating apparatus 100 so that the opening portion is disposed on the front side of the microwave heating apparatus 100.

The way of engaging the tank casing door member 31 with the operation member 35 will be described below in detail.

Figure 12A:
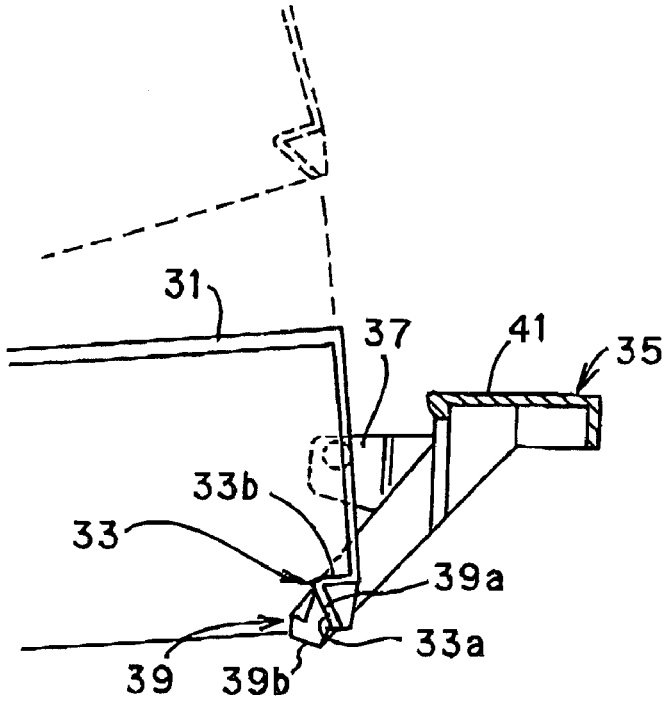
FIG. 12A to FIG. 12C are sectional views for explaining the way of engaging the operation member with a tank casing door member.
Figure 12B:
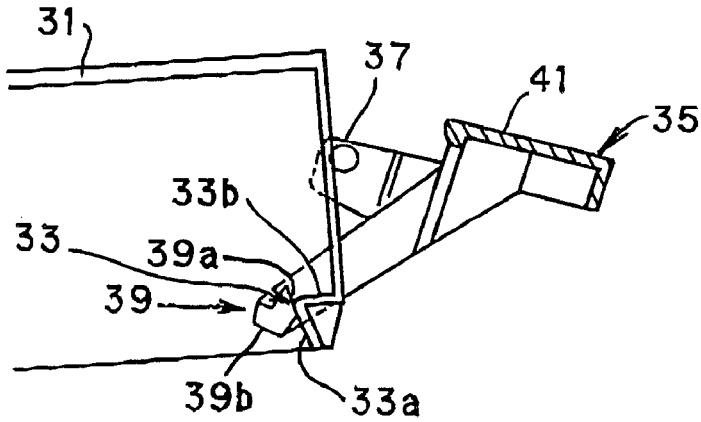
Figure 12C:
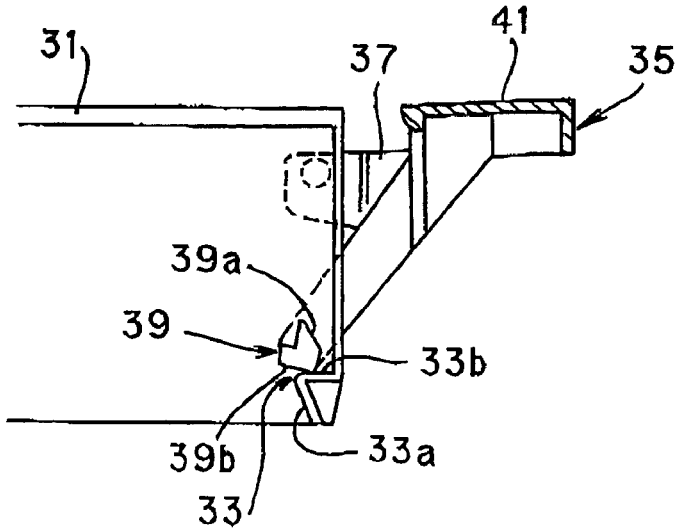

FIG. 12A to FIG. 12C show the engagement of respective members stepwise. When the tank casing door member 31 in an opened state is first pushed into the tank casing body side as shown in FIG. 12A, an abutting surface 33*a* formed in the lock portion 33 of the tank casing door member 31 abuts on an abutting surface 39*a* formed in the engagement portion 39 of the operation member 35 as shown in FIG. 12B. When the tank casing door member 31 is further pushed into the tank casing body side, the abutting surfaces 39*a* and 33*a* slide on each other to rotate the operation member 35 in the pushing-down direction against the biasing force of the barrel-shaped coiled springs 45 to thereby push down the push button 41 more deeply than an outer surface of a decoration panel 47.

That is, each of the abutting surfaces 33*a* and 39*a* has a length sufficient to slide continuously until the push button 41 is pushed down more deeply than the outer surface of the decoration panel 47.

When sliding of the abutting surfaces 33*a* and 39*a* is then completed, the operation member 35 is rotated in a reverse direction by the biasing force of the barrel-shaped coiled springs 45 as shown in FIG. 12C. As a result, an engagement surface 33*b* formed in the lock portion 33 is engaged with an engagement surface 39*b* formed in the engagement portion 39, so that the tank casing door member 31 is kept closed, that is, locked.

The exterior panel 65 forming the body casing 10 is mounted on the microwave heating apparatus 100 to which the storage unit 20 has been attached in the aforementioned manner. Opposite side surfaces and a top surface of the microwave heating apparatus 100 are covered with the exterior panel 65.

For example, the exterior panel 65 is made of an iron plate bent. The exterior panel 65 has a pair of side portions 67 for forming opposite side surfaces, and a top portion 69 for forming a top surface (see FIG. 4). The exterior panel 65 further has an opening portion 71 formed in one of the side portions 67. When the exterior panel 65 is mounted on the microwave heating apparatus 100, the storage unit 20 is disposed in the opening portion 71. That is, the storage unit 20 is provided as a structure in which the storage unit 20 is surrounded with the opening portion 71 of the exterior panel 65.

The exterior panel 65 further has engagement pawls 73 and 75 at front ends of the side portions 67 and the top portion 69. These engagement pawls 73 and 75 are engaged with a frame portion 77 forming a front side of the microwave heating apparatus 100.

That is, the exterior panel 65 is put on the microwave heating apparatus 100 while the engagement pawls 73 and 75 are engaged with the frame portion 77. Then, a rear portion or a side portion is fixed by fixing means such as screws. Then, a decoration panel 47 is fitted into a gap between the storage unit 20 and the opening portion 71 of the exterior panel 65. When these members are assembled in this manner, the visual shape shown in FIG. 1 can be obtained in the condition that the water supply tank 17 is stored in the inside of the microwave heating apparatus 100.

The procedure for putting and mounting the exterior panel 65 on the microwave heating apparatus 100 will be described below with reference to FIG. 13A to FIG. 13D.

Figure 13A:
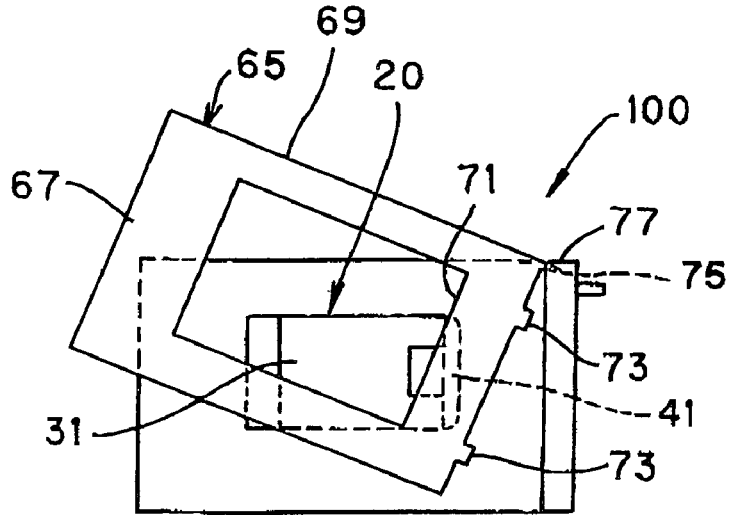
FIG. 13A to FIG. 13D are explanatory views showing a procedure for mounting an exterior panel in the microwave heating apparatus.

First, as shown in FIG. 13A, in the condition that the side portion 67 having the opening portion 71 of the exterior panel 65 is opened with respect to the top portion 69, the engagement pawl 75 formed in the top portion 69 is engaged with the frame portion 77.

Figure 13B:
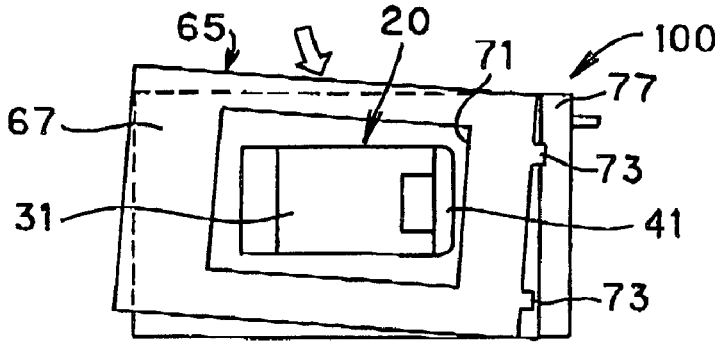

Then, as shown in FIG. 13B, in the condition that the engagement pawls 73 of the side portion 67 are outside the frame portion 77, the exterior panel 65 is put on the microwave heating apparatus 100 up to a position where the front side circumferential edge of the opening portion 71 climbs over the push button 41 on the front side of the storage unit 20.

Figure 13C:
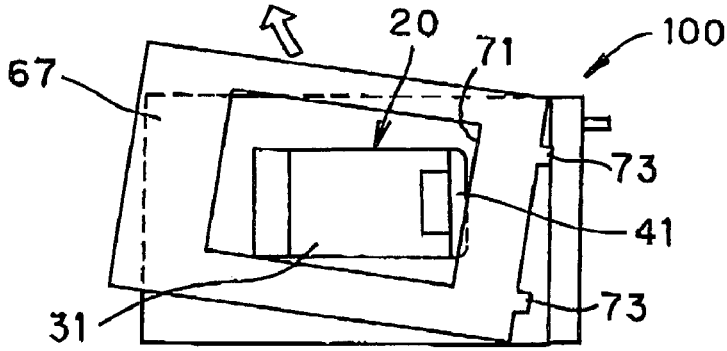
Figure 14:
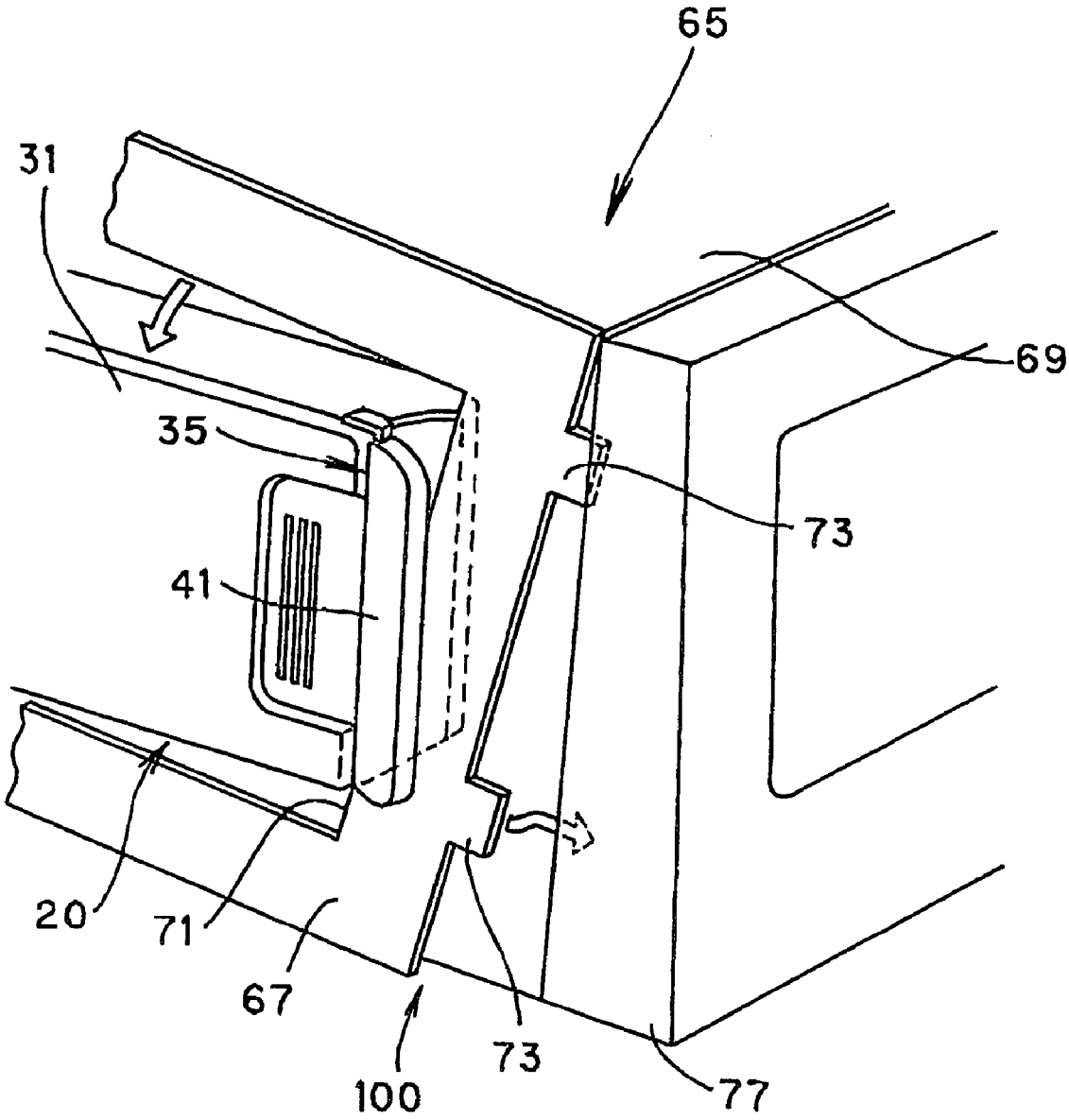
FIG. 14 is a perspective view showing part of the microwave heating apparatus for explaining the way of mounting the exterior panel in the microwave heating apparatus.

In this state, as shown in FIG. 13C, the side portion 67 is forced into the microwave heating apparatus 100 side and the exterior panel 65 is pulled up while the engagement pawl 75 is kept engaged with the frame portion 77. As shown enlargedly in FIG. 14, the front side circumferential edge of the opening portion 71 is inserted into the space on the back of the push button 41 of the operation member 35, so that the upper engagement pawl 73 of the side portion 67 is disposed in the inner position of the frame portion 77.

On this occasion, the push button 41 is biased in a direction reverse to the pushing-down direction and inclined outward the microwave heating apparatus 100. The barrel-shaped coiled springs 45 biasing the push button 41 are provided so that the portion in which the coil diameter of each spring 45 is tapered is disposed in the opening portion. Accordingly, a wide space is formed on the back of the push button 41. Accordingly, the front side circumferential edge of the opening portion 71 of the exterior panel 65 can afford to be deeply inserted into the space on the back of the push button 41.

Figure 13D:
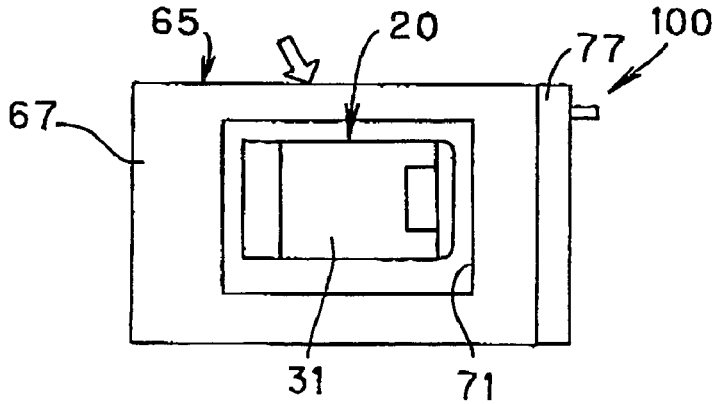

Then, as shown in FIG. 13D, the side portion 67 is further forced into the microwave heating apparatus 100 side and the exterior panel 65 is entirely put and mounted on the microwave heating apparatus 100 while the engagement pawls 73 of the side portion 67 are engaged with the frame portion 77.

Finally, the decoration panel 47 is fitted into a gap between the storage unit 20 and the opening portion 71 of the exterior panel 65 to thereby fill the gap between the storage unit 20 and the exterior panel 65.

Before the decoration panel 47 is mounted, the push button 41 of the operation member 35 is protruded from the panel surface which is an outer surface of the exterior panel 65, in a state in which the tank casing door member 31 is locked on the tank casing body 27. More in detail, the outer surface of the tank casing door member 31 of the attached storage unit 20 is slightly protruded from the panel surface of the exterior panel 65. For this reason, the push button 41 of the operation member 35 is protruded outward the microwave heating apparatus 100 from the outer surface of the tank casing door member 31. The decoration panel 47 has an outer circumferential edge formed as a smooth curved surface.

When the decoration panel 47 is mounted in the gap between the storage unit 20 and the opening portion 71 of the exterior panel 65, the operation member 35 is pushed in by the decoration panel 47 so that the push button 41 is disposed so as to be substantially on the same plane with the outer surface of the decoration panel 47. In this manner, the side surface of the microwave heating apparatus 100 is formed as a nearly smooth continuous surface.

Figure 15A:
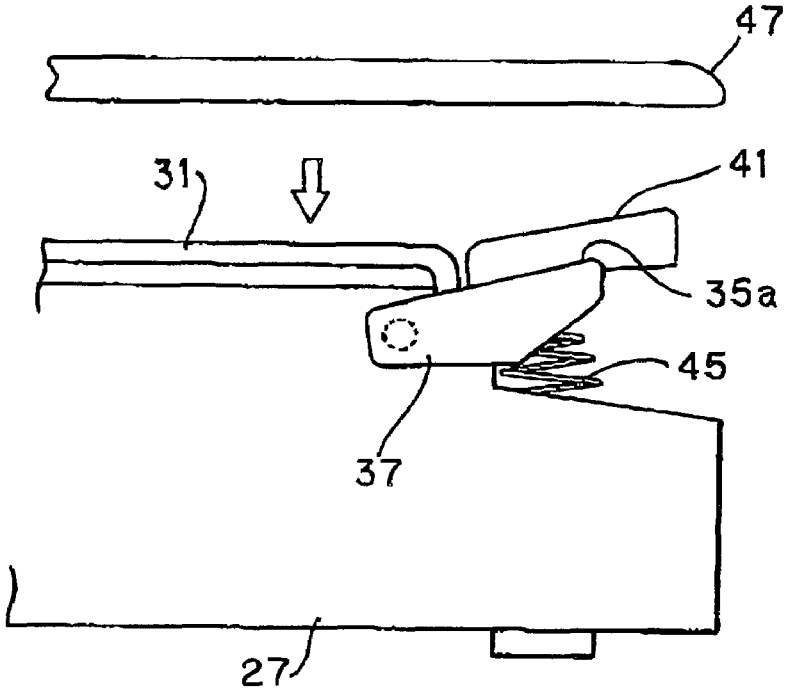
FIG. 15A and FIG. 15B are side views showing part of the storage unit for explaining the mount state of a decoration panel.
Figure 15B:
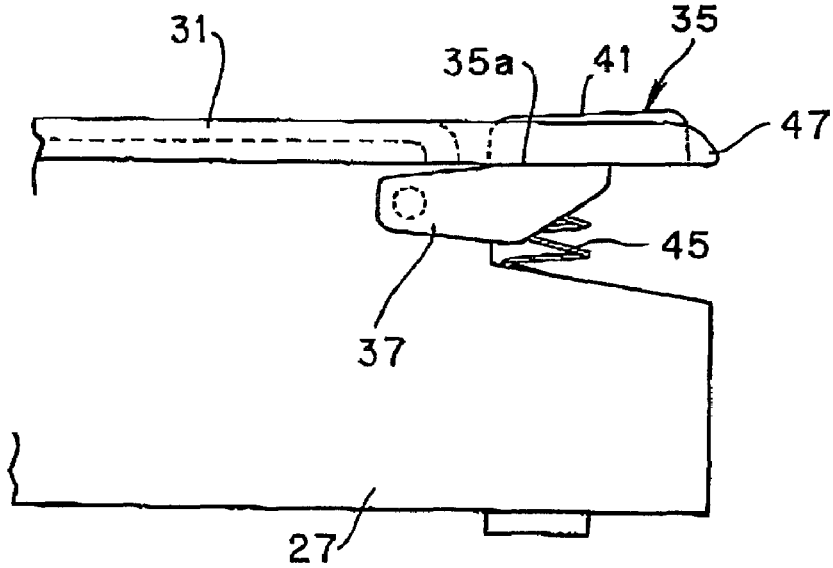

FIG. 15A and FIG. 15B are side views showing part of the storage unit for explaining the mount state of the decoration panel. When the decoration panel 47 is fitted from a state shown in FIG. 15A to a state shown in FIG. 15B, step portions 35*a* formed at opposite end portions of the operation member 35 are pushed in by the decoration panel 47 so that the push button 41 of the operation member 35 is set substantially on the same plane with the outer surface of the decoration panel 47. In this manner, the operation member 35 having a large aperture angle θ after the mounting of the exterior panel 65 is finally flattened by the mounting of the decoration panel 47 so that the operation member 35 is little protruded outward.

As described above, in the attachment structure of the storage unit 20 according to the invention, there can be achieved an operation of unlocking the tank casing door member 31 and opening the tank casing door member 31 outward a side of the microwave heating apparatus 100 in the biasing direction by pushing down the push button 41 and an operation of closing and locking the tank casing door member 31 by pushing back the tank casing door member 31 in a direction reverse to the biasing direction. Before the exterior panel 65 for the storage unit 20 is mounted, the push button 41 of the operation member 35 is protruded outward a side of the microwave heating apparatus 100 in the condition that the tank casing door member 31 is locked. A space for inserting the circumferential edge of the opening portion 71 of the exterior panel 65 is formed sufficiently. Accordingly, facilitation of putting and mounting the exterior panel 65 on the microwave heating apparatus 100 can be ensured. In addition, the degree of freedom in design of the equipment is improved, so that reduction in size of the equipment can be attained.

After the storage unit 20 is assembled, the push button 41 of the operation member 35 is set substantially on the same plane with the outer surface of the decoration panel 47. Accordingly, the protrusive portion on the outer surface of the microwave heating apparatus 100 can be eliminated. Furthermore, because the tank casing door member 31 is opened when the push button 41 is pushed down so as to be deeper than the outer surface of the decoration panel 47, a drawback in opening of the tank casing door member 31 carelessly can be eliminated surely.

Specifically, when the tank casing door member 31 opened is forced into the microwave heating apparatus 100 side, the abutting surfaces 33*a* and 39*a* slide on each other and then the engagement surfaces 33*b* and 39*b* are engaged with each other. Accordingly, the tank casing door member 31 can be kept closed steadily and easily.

According to the microwave heating apparatus 100 assembled in the aforementioned manner, because the water supply tank 17 is disposed so as to be attachable/detachable to/from the microwave heating apparatus 100, water can be exchanged easily so that sanitary water supply can be performed. Furthermore, because the water supply tank 17 is disposed in a side surface of the microwave heating apparatus 100, the water supply tank 17 exerts no influence on the heating operation from the front side of the microwave heating apparatus 100. In addition, because the rotary shaft of the tank casing door member 31 is provided in the inner side of the microwave heating apparatus 100, the tank casing door member 31 can be opened on the front side. Accordingly, the water supply tank 17 can be attached/detached with good handling property on the front side.

Although the description has been made above on the case where the water supply tank 17 is disposed in one side surface of the microwave heating apparatus 100, the water supply tank 17 may be disposed in any place such as the other side surface, a top surface or a bottom surface. Also in this case, the water supply tank 17 can be attached/detached with good handling property by an operation of pulling out the storage unit outward the microwave heating apparatus 100 and then attaching/detaching the water supply tank 17 on the front side.

In addition, because the water supply tank 17 is compactly stored in the body casing 10 of the microwave heating apparatus 100, the casing size of the microwave heating apparatus 100 need not be particularly increased. Accordingly, the installation area can be prevented from being enlarged.

Although the embodiment has been described on the case where the microwave heating apparatus is taken as an example of the equipment to which the storage unit 20 is attached, the attachment structure of the storage unit 20 is not limited thereto. For example, the attachment structure of the storage unit 20 may be applied to various kinds of equipment other than the microwave heating apparatus. Any other object than the water supply tank 17 may be used as the object to be stored in the storage unit 20.

As described above in detail, in the attachment structure of the storage unit according to the invention, the open/close member is unlocked when the push button of the operation member is pushed down, and the open/close member is locked on the casing base when the open/close member is pushed back in a direction reverse to the biasing direction of the operation member. When the open/close member is locked, the push button of the operation member is protruded from the panel surface in the mount position of the exterior panel. Accordingly, a space for inserting the circumferential edge of the opening portion of the exterior panel is formed. For putting and mounting the exterior panel on the equipment, the circumferential edge of the opening portion of the exterior panel can be inserted into this space, so that the exterior panel can be mounted easily. In addition, the degree of freedom in design of the equipment is improved, so that reduction in size of the equipment can be attained.

What is claimed is:

1. An attachment structure of a storage unit comprising:

a casing base attached to an equipment, wherein said casing base and a side surface of said equipment form a space for holding an object to be stored;

an open/close member including a support portion for supporting said open/close member to said casing base on one side so as to make said open/close member opened/closed freely, and a lock portion for locking said open/close member on said casing base on the other side, said open/close member blocking a space of said casing base in a closed state and biased in a direction of departing from said casing base; and an operation member including an engagement portion engaged with said lock portion to keep said open/close member locked on said casing base, a push button for unlocking said open/close member by a pushing-down operation of said push button, and support members rotatably supported to said casing base, wherein an outer circumference of said storage unit is surrounded with an opening portion of an exterior panel of said equipment;

said push button has opposite ends, said support members are formed at said opposite ends of said push button, and said engagement portion is directly attached to said push button;

said push button of said operation member is protruded from an outer side surface of said exterior panel in a mount position of said exterior panel, when said exterior panel is in assembling work; and a circumferential edge of said opening portion of said exterior panel is inserted into a space on the back of said push button.

2. An attachment structure of a storage unit according to claim 1, wherein said operation member is biased in a direction reverse to the pushing-down direction by barrel-shaped coiled springs.

3. An attachment structure of a storage unit according to claim 1, wherein said exterior panel has a top surface and opposing side surfaces, and said opening portion is located on one of said side surfaces of said exterior panel.

4. An attachment structure of a storage unit, comprising:

a casing base attached to an equipment, wherein said casing base and a side surface of said equipment form a space for holding an object to be stored;

an open/close member including a support portion for supporting said open/close member to said casing base on one side so as to make said open/close member opened/closed freely, and a lock portion for locking said open/close member on said casing base on the other side, said open/close member blocking a space of said casing base in a closed state and biased in a direction of departing from said casing base; and an operation member including an engagement portion engaged with said lock portion to keep said open/close member locked on said casing base, a push button for unlocking said open/close member by a pushing-down operation of said push button, and support members rotatably supported to said casing base, wherein an outer circumference of said storage unit is surrounded with an opening portion of an exterior panel of said equipment;

said push button of said operation member is protruded from a panel surface which is an outer surface of said exterior panel in a mount position of said exterior panel, when said exterior panel is in assembling work; and a circumferential edge of said opening portion of said exterior panel is inserted into a space on the back of said push button, wherein a decoration panel for covering a gap between said storage unit and said opening portion of said mounted exterior panel is fixed so that said push button of said operation member protruded from said panel surface is substantially on the same plane with an outer surface of said decoration panel.

5. An attachment structure of a storage unit according to claim 4, wherein said open/close member is unlocked from said casing base when said push button of said operation member is pushed down so as to be deeper than said outer surface of said decoration panel.

6. An attachment structure of a storage unit according to claim 5, wherein each of said lock portion of said open/close member and said engagement portion of said operation member has an abutting surface, and an engagement surface, said respective abutting surfaces sliding while abutting on each other, said respective engagement surfaces engaged with each other when sliding of said abutting surfaces is completed, each of said abutting surfaces has a length sufficient to slide continuously from a state in which said push button of said operation member is protruded from said panel surface to a state in which said push button is pushed down so as to be deeper than said outer surface of said decoration panel.

* * * * *

UNITED STATES PATENT AND TRADEMARK OFFICE

CERTIFICATE OF CORRECTION

PATENT NO. : 7,645,966 B2
APPLICATION NO. : 10/653648
DATED : January 12, 2010
INVENTOR(S) : Yuji Hayakawa et al.

It is certified that error appears in the above-identified patent and that said Letters Patent is hereby corrected as shown below:

Title Page, (*) Notice: Subject to any disclaimer, the term of this patent is extended or adjusted under 35 U.S.C. 154(b) by 1,105 days.

should read (*) Notice: Subject to any disclaimer, the term of this patent is extended or adjusted under 35 U.S.C. 154(b) by 1,696 days.

In column 3, line 53 should read:

Fig. 9 is a perspective view showing a mounting structure

In column 5, line 57 should read:

As shown in Fig. 5A and Fig. 5B, a water feed pump 29 is

Signed and Sealed this

Thirteenth Day of July, 2010

David J. Kappos

David J. Kappos
*Director of the United States Patent and Trademark Office*